US009663315B2

(12) United States Patent
Hashikawa et al.

(10) Patent No.: US 9,663,315 B2
(45) Date of Patent: May 30, 2017

(54) SUCTION ROLL DEVICE

(71) Applicant: JDC, inc., Sasebo-shi, Nagasaki (JP)

(72) Inventors: Yoshito Hashikawa, Sasebo (JP); Ryouta Ikeda, Sasebo (JP)

(73) Assignee: JDC, inc., Sasebo-Shi (JP)

( * ) Notice: Subject to any disclaimer, the term of this patent is extended or adjusted under 35 U.S.C. 154(b) by 14 days.

(21) Appl. No.: 14/403,342

(22) PCT Filed: Feb. 6, 2013

(86) PCT No.: PCT/JP2013/052742

§ 371 (c)(1),
(2) Date: Nov. 24, 2014

(87) PCT Pub. No.: WO2014/122737

PCT Pub. Date: Aug. 14, 2014

(65) Prior Publication Data

US 2015/0102153 A1 Apr. 16, 2015

(51) Int. Cl.
*B65H 20/12* (2006.01)
*B65H 23/24* (2006.01)
(Continued)

(52) U.S. Cl.
CPC ..... *B65H 20/12* (2013.01); *B65H 23/245* (2013.01); *B65H 23/14* (2013.01); *B65H 27/00* (2013.01);
(Continued)

(58) Field of Classification Search
CPC ..... B65H 3/0692; B65H 3/10; B65H 3/12; B65H 5/222; B65H 5/226; B65H 20/12;
(Continued)

(56) References Cited

U.S. PATENT DOCUMENTS 4,011,975 A * 3/1977 Brown, Jr. ..... B26D 5/34 101/228
4,437,369 A * 3/1984 Brocklehurst ..... D06H 7/025 226/33
(Continued)

FOREIGN PATENT DOCUMENTS

JP S63-267648 A 11/1988
JP S63-299816 A 12/1988
(Continued)

*Primary Examiner* — Michael McCullough

(57) ABSTRACT

The negative pressure roll 1 is provided with a rotating shaft 2, an internal cylinder 3, an intermediate cylinder 4 and a multi-layered non-woven fabric laminated outer layer 5. Further, the rotating shaft 2 is a member at the center of rotation of the negative pressure roll 1 and connected to the internal cylinder 3 by a reinforcement circular disk 9. Still further, the internal cylinder 3 is formed in a tubular shape and rotates together with the rotating shaft 2. In addition, the rotating shaft 2 and the internal cylinder 3 correspond to a rotating main body. Further, the intermediate cylinder 4 is a cylindrical tubular material formed outside the internal cylinder 3 and rotates in association with the rotating shaft 2 and the internal cylinder 3. Still further, the multi-layered non-woven fabric laminated outer layer 5 is formed outside the intermediate cylinder 4 and given as a part at which the negative pressure roll 1 is in contact with the metal strip 13. The multi-layered non-woven fabric laminated outer layer 5 also rotates in association with the rotating shaft 2, the internal cylinder 3 and the intermediate cylinder 4. In addition, the negative pressure roll 1 is provided with a controller 6 for suppressing rotation of the negative pressure roll 1.

14 Claims, 12 Drawing Sheets

(51) Int. Cl.
*B65H 23/14* (2006.01)
*B65H 27/00* (2006.01)

(52) U.S. Cl.
CPC ..... *B65H 2401/244* (2013.01); *B65H 2403/7255* (2013.01); *B65H 2406/33* (2013.01); *B65H 2406/332* (2013.01); *B65H 2701/173* (2013.01)

(58) Field of Classification Search
CPC B65H 23/245; B65H 29/243; B65H 2406/33; B65H 1401/244; B65H 2401/244
See application file for complete search history.

(56) References Cited

U.S. PATENT DOCUMENTS 6,581,517 B1 * 6/2003 Becker ..... B41F 13/18 101/389.1
8,119,055 B2 * 2/2012 Pellengo Gatti ..... B65H 18/00 242/417
8,640,862 B2 * 2/2014 Perrin ..... D21F 7/10 198/844.1
2010/0203788 A1 * 8/2010 Kimura ..... D04H 1/005 442/327
2012/0085853 A1 4/2012 Hashikawa
2013/0200127 A1 * 8/2013 Bentchev ..... B65H 20/12 226/95

FOREIGN PATENT DOCUMENTS

JP H05-253615 A 10/1993
JP H06-238329 A 8/1994
JP H07-127631 A 5/1995
JP H09-175700 A 7/1997
JP 2000-108299 A 4/2000
JP 2004-142936 A 5/2004
JP 2004-230449 A 8/2004
JP 2005-262310 A 9/2005
JP 2008-137804 A 6/2008
JP 2012-081477 A 4/2012

* cited by examiner (a)

(b)

SUCTION ROLL DEVICE

CROSS REFERENCE TO RELATED APPLICATIONS

This patent application is a U.S. national stage application under 35 U.S.C. §371 of International Patent Application No. PCT/JP2013/052742 filed on Feb. 6, 2013, the disclosure of which is hereby incorporated by reference in its entirety. The International Application was published in Japanese on Aug. 14, 2014, as International Publication No. WO 2014/122737 A1 under PCT Article 21(2).

TECHNICAL FIELD

The present invention relates to a suction roll device. More specifically, the present invention relates to a suction roll device which is capable of firmly gripping and conveying or controlling a variety of long materials without damaging them and also capable of reliably winding them.

BACKGROUND ART

There exist long materials which can be cut and processed depending on a product to be used and an object. These long materials include metal strips having a predetermined thickness and sheet-like products formed with paper, resin and the like. Each of the materials is, in general, shipped in a state of being wound many times around a core like a coil and overlapped.

The above-described long materials include not only a step of molding a starting material but also many related steps such as a step of winding the material around a core, a step of drawing the thus wound material, a step of gripping and conveying the material, and a step of cutting the material to a required width. The individual steps of handling the long materials are important in enhancing the quality and production efficiency of a final product.

For example, metal strips are used as raw materials for various products such as automobiles, consumer electronics, construction materials, steel furniture, electric components and electron components. The metal strips are different in width and thickness depending on use and available in thickness from several μm of a metal foil to several mm of a metal strip.

Further, a range of metal strip widths are available, for example, from several mm of a slit-processed narrow strip to more than 2 meters of metal coil base material prior to a cutting process.

A device for processing the above-described metal strips includes a slitter line which cuts a wide metal coil base material to a fixed width in the longitudinal direction and winds up the material as multiple strips. In addition, the strip means a unit of the number of strips.

The slitter line is a device in which the metal coil base material is drawn from a rotating roll to cut a strip to a desired width by using a slitter and the strip is again wound up around the rotating roll of the recoiler and processed into a metal strip coil.

On the slitter line, it is important to impart an appropriate winding tensile force to a metal strip which is finally wound up by the roll of the recoiler to give tension, thereby neatly winding the metal strip. Where there is a failure in imparting an appropriate winding tensile force to the metal strip coil, the metal strip coil after processing is wound erroneously or an edge of the thus wound coil is made irregular, thereby exhibiting a poor appearance, which poses a problem.

Therefore, on the slitter line, in order to impart an appropriate winding tensile force to the metal strip coil, for example, there exist a winding tensile force imparting device according to a tension pad method (for example, Patent Document 1) and a device according to a roll tension method (for example, Patent Document 2).

However, in the above-described individual devices, on imparting a winding tensile force, abrasions and smears will adhere on the surface of the strip coil. A problem is also posed such that no winding tensile force can be imparted uniformly to all the strip coils.

Under these circumstances, there exists a winding tensile force imparting device which imparts a sufficient winding tensile force to metal strips. For example, Patent Document 3 has proposed a winding tensile force imparting device.

Here, Patent Document 3 has disclosed a winding tensile force imparting device 100 as shown in FIG. 14(*a*). The winding tensile force imparting device 100 presses a metal strip vertically and is provided with a tension pad 101 which imparts a tensile force. Further, back-tension imparting elastic rolls 102 and 103, each of which is composed of a closely attached laminated product made up of many rubber-like thin elastic circular disks, are arrayed before and after the tension pad.

The winding tensile force imparting device 100 imparts a sufficient winding tensile force to multiple metal strips in combination of the tension pad 101 with the back tension imparting elastic rolls 102 and 103.

On the other hand, sheet-like products formed with paper, resin and the like are materials used in a printer, a packaging machine and a coater. In order to use the sheet-like products effectively and efficiently, it is important to reliably grip and convey long materials while steps are in progress. At this time, there exists a suction roll device which is used as a device for gripping and conveying them.

The suction roll device is such that sheet-like products are adsorbed on an outer circumferential face of a rotating roll to grip and convey long materials. The suction roll device is provided with a region which develops a negative pressure, thereby generating an adsorption force derived from the negative pressure.

Further, the suction roll device includes a device in which an outer circumferential face of a roll is constituted with a porous body so as not to leave adsorption-derived marks on a sheet-like product to be conveyed. However, fine holes on the outer circumference of the roll are clogged with dust and chemicals. Thus, it is necessary to clean the device in a short period of time, resulting in a decreased operating rate, which poses a problem.

Under these circumstances, there exists a suction roll device which does not leave adsorption marks on a sheet-like product and is also less likely to have clogging of fine holes. For example, Patent Document 4 discloses this type of suction roll device.

At this time, Patent Document 4 discloses a suction roll device 200 shown in FIG. 14(*b*). The suction roll device 200 is provided with a center shaft 202 supported by a support frame 201 which opposes thereto and a cylindrical porous body 203 which is breathable. A plurality of air paths (not illustrated) are formed between the center shaft 202 and the cylindrical porous body 203 in a circumferential direction, with a predetermined interval kept.

Further, there is formed a suction port 205 which opposes one end opening portion 204 of each of some of the plurality of air paths. A pressuring port 207 which opposes the other end opening portion 206 of each of some of the plurality of air paths which are not communicatively connected with the suction port 205, is also formed.

In the suction roll device 200, a negative pressure developed on the side of the suction port 205 is guided into an air path to generate an adsorption force on an outer circumferential face of the cylindrical porous body 203 outside the air path. Further, a positive pressure formed on the side of the pressuring port 207 is guided into an air path and released outside through the cylindrical porous body 203, by which dust and other matter adhered on fine holes are released outside.

The suction roll device also includes a device which is able to adjust a suction width according to the width of a sheet-like product; for example, the suction roll device disclosed in Patent Document 5 exists.

At this time, Patent Document 5 discloses a suction roll device 300 which is shown in FIG. 15. The suction roll device 300 is provided with an external cylinder 301 which rotates freely and an internal cylinder 302 which is fixed. Further, there is provided a driving shaft 303 having a suction port inside the internal cylinder 302, and there is also formed a partition strip 304 which is able to move axially inside the internal cylinder.

Further, the suction roll device 300 allows the partition strip 304 to move inside the internal cylinder by rotational movement of the driving shaft 303, thereby making it possible to adjust a range to be sucked from an opening portion 305.

PRIOR ART DOCUMENTS

Patent Literature

Patent Document 1: Japanese Published Unexamined Patent Application No. 2005-262310
Patent Document 2: Japanese Published Unexamined Patent Application No. Hei-5-253615
Patent Document 3: Japanese Published Unexamined Patent Application No. Hei-6-238329
Patent Document 4: Japanese Published Unexamined Patent Application No. 2008-137804
Patent Document 5: Japanese Published Unexamined Patent Application No. Hei-7-127631
Patent Document 6: Japanese Published Unexamined Patent Application No. 2004-230449
Patent Document 7: Japanese Published Unexamined Patent Application No. 2012-81477

SUMMARY OF THE INVENTION

Problems to be Solved by the Invention

However, in the winding tensile force imparting device disclosed in Patent Document 3, a metal strip is held between the elastic circular-disk stacked rolls which are arrayed vertically and subjected to compression bonding, thereby causing marks on the surface of a thin metal strip due to the compression bonding, which poses a problem. Further, use of the tension pad will cause abrasions on the surface of a metal strip due to pressing by the pad. An abrasion on the surface of the metal strip is a critical defect for a metal strip used in an application which requires sophisticated surface finishing.

Further, as our own prior art, there exists a winding tensile force imparting device on the basis of a multiple strip belt-type tension method (Patent Document 6 and Patent Document 7) in which many divided endless belts are used to hold a metal strip vertically, thereby imparting a winding tensile force by means of a frictional force on the back of the belt.

In the device based on the multiple strip belt-type tension method, there is a difference in friction coefficient between the inside and the outside of the belt, thus making it possible to impart a uniform tensile force to each of the strips. Further, since the strip does not slide but moves rotationally on the surface of the belt, abrasions are less likely to develop on the surface of the strip.

However, in the device based on the multiple strip belt-type tension method, multiple strip belts are arrayed, with a predetermined interval kept. For example, in dealing with a very thin strip with a thickness of less than 0.1 mm, there is a case in which marks caused by an edge of an end of the belt may adhere on the surface of the strip.

Further, in dealing with a narrow metal strip with a width of 10 mm or less, there is a case in which the metal strip may drop into a space between the belts, which results in a failure of imparting a sufficient tensile force.

Thus, there has been demanded a device for imparting a winding tensile force to a metal strip or a device which is capable of imparting a uniform winding tensile force to multiple metal strips without damaging the surface of the metal strip and, in particular, imparting a sufficient winding tensile force to a thin strip or a narrow strip.

On the other hand, the suction roll device disclosed in Patent Document 4 is able to develop a negative pressure that can convey a thin and light material such as paper and film but unable to develop a negative pressure that imparts a sufficient winding tensile force to a heavy material such as a metal strip. That is, the device is unable to develop a great negative pressure and cannot be used as a winding tensile force imparting device.

Further, according to Patent Document 4, the cylindrical porous body is made of ceramic. Since ceramic is small in friction coefficient, no sufficient frictional force is developed between an outer circumferential face of ceramic and a metal strip. That is, no winding tensile force can be imparted to metal strips by the use of frictional engagement.

Still further, the suction roll device disclosed in Patent Document 4 is unable to control a suction width of a suction roll according to the width of a sheet-like product. That is, where the sheet-like product is narrower than the suction width of the roll, air is sucked through ventilation holes outside the width of the sheet-like product. As a result, the sheet-like product is not sufficiently adsorbed on the surface of the suction roll to become deficient in gripping force, which becomes a cause for a failure in conveyance.

In addition, the suction roll device disclosed in Patent Document 5 is able to adjust the suction width depending on the width of a sheet-like product. However, the device is unable to impart a sufficient negative pressure to a target substance which is arrayed like multiple metal strips.

That is, there is an empty space formed by a separator on a slitter line between metal strips after being slit, and air flows through the empty space. It is impossible to keep a great negative pressure inside the device, due to the flow of air. Therefore, the suction roll device disclosed in Patent Document 5 is also difficult in imparting a sufficient winding tensile force to the metal strip.

The present invention has been made from the viewpoint of the above situation, an object of which is to provide a suction roll device which is capable of sufficiently gripping and conveying or controlling a variety of long materials without damaging them and also capable of reliably winding them.

Means for Solving the Problems

In order to achieve the above-described object, the suction roll device of the present invention is provided with a rotating body which has a rotating main body which is arranged so as to rotate freely, a conduction hole which is installed inside the rotating main body to develop a negative pressure by a predetermined suction device and a conduction groove which is formed on the surface of the rotating main body and connected to the conduction hole, a control portion which suppresses rotation of the rotating main body, and an outer layer portion low in breathability which is formed outside all the conduction grooves, is provided with elasticity and has a friction coefficient higher than a predetermined value.

At this time, the rotating body is provided with the conduction hole which is installed inside the rotating main body and also at which a negative pressure is developed by the predetermined suction device. Thereby, the inside of the rotating body can be kept at a negative pressure. The predetermined suction device includes, for example, a vacuum pump and an ejector. The predetermined suction device is connected to the conduction hole to discharge air from inside the rotating body, thus making it possible to develop a negative pressure in the suction roll device.

Further, the rotating body is provided with the conduction groove which is formed on the surface of the rotating main body and also connected to the conduction hole. Thereby, the conduction groove is linked with the conduction hole to widen a negative pressure region developed in the conduction hole to the surface of the rotating body.

Further, the rotating body is provided with the conduction groove which is formed on the surface of the rotating main body and connected to the conduction hole. Thereby, it is possible to widen a negative pressure region by the conduction groove. That is, the negative pressure can be exerted on an end portion of the roll away from an induction hole inside the device.

Further, the rotating body is provided with the conduction hole at which a negative pressure is developed by a predetermined suction device and the conduction groove which is formed on the surface of the rotating main body and connected to the conduction hole. Thereby, the rotating body is able to exert a negative pressure on a target substance in contact with the surface of the rotating main body and able to adsorb the target substance. In addition, here, adsorption by a negative pressure is derived from a pressing force by air acting on the surface of the target substance in contact with the rotating main body. Further, the target substance in contact with the surface thereof means, for example, a long metal strip.

Further, the rotating body which has the conduction hole at which a negative pressure is developed by a predetermined suction device and the conduction groove which is formed on the surface of the rotating main body and also connected to the conduction hole, is provided. And, there is also provided the outer layer portion low in breathability which is formed outside all the conduction grooves. Thereby, it is possible to widen a negative pressure region inside the device and also decrease a quantity of air flowing into the device from outside. That is, the device is increased in a negative pressure degree inside the device and able to intensify an adsorption force acting on a target substance in contact with the device.

Further, the control portion which suppresses rotation of the rotating main body is provided. It is, thereby, possible to apply a desired braking force to rotation of the rotating main body.

Further, the outer layer portion which is formed outside all the conduction grooves and has a friction coefficient higher than a predetermined value is provided. Thereby, a target substance in contact with the device makes a frictional engagement with the device, thus making it possible to develop a strong frictional force between the device and the target substance. Where the device comes into contact with, for example, a metal strip which is wound up, the device is able to exert on the metal strip a frictional resistance reverse to a moving direction.

Further, the rotating main body which is arranged so as to rotate freely and the outer layer portion which is formed outside all the conduction grooves and also has a friction coefficient higher than a predetermined value, are provided. Thereby, it is possible to rotate the rotating main body by a frictional force. That is, a target substance which is wound up comes into contact with the device to develop a frictional force, thereby rotating the rotating main body.

Further, the control portion which suppresses rotation of the rotating main body and the outer layer portion low in breathability which is formed outside all the conduction grooves and has a friction coefficient higher than a predetermined value, are provided. It is, thereby, possible to impart a winding tensile force to a target substance in contact with the device. That is, the target substance is subjected to an adsorption force derived from a negative pressure, and a braking force is applied to rotation of the rotating main body. Thereby, a frictional force developed between the target substance and the outer layer portion is made as a winding tensile force to the target substance which is wound up.

Further, the control portion which suppresses rotation of the rotating main body and the outer layer portion which is formed outside all the conduction grooves and has a friction coefficient higher than a predetermined value, are provided. It is, thereby, possible to adjust a braking force to the rotating main body and also adjust a winding tensile force acting on a target substance in contact with the device.

Further, the control portion which suppresses rotation of the rotating main body and the outer layer portion low in breathability which is formed outside all the conduction grooves and has a friction coefficient higher than a predetermined value, are provided. Thereby, it is possible to impart a sufficient winding tensile force to a target substance in contact with the device. That is, the device is increased in a negative pressure degree inside the device to enhance a braking force, thus making it possible to intensify a winding tensile force to the target substance.

Further, the control portion which suppresses rotation of the rotating main body and the outer layer portion low in breathability which is formed outside all the conduction grooves and has a friction coefficient higher than a predetermined value, are provided. Thereby, it is possible to impart a uniform winding tensile force to a multiple strip target substance which is cut to a desired width. That is, even in the presence of a clearance between target substances, air flowing into the device through the clearance is decreased in quantity. And, a negative pressure is kept high, thus making it possible to impart a sufficient winding tensile force.

Further, the outer layer portion which is elastic and formed outside all the conduction grooves is provided. Thereby, the surface of a target substance in contact with the device, for example, the surface of a coated or plated material, is less likely to be damaged.

Further, where the driver which rotates the rotating main body is provided, it is possible to rotate the rotating main body independently. Thereby, where the device is used, for example, in an application in which wide sheet-like products formed with paper, resin and the like are gripped and conveyed, the sheet-like products can be conveyed reliably. Still further, the device can be arrayed, for example, on a slitter line to grip and convey a metal strip in contact with the device.

Further, where the clutch which attaches the driver to the rotating main body in a detachable manner is provided, it is possible to quickly switch between transmission of a driving force to the rotating main body and halt thereof. For example, where it is desired to impart a winding tensile force at a midpoint while a target substance in contact with the device is gripped and conveyed, the clutch is changed to a release position to cut off the driver, thus making it possible to quickly switch to a state that only the control portion works on the rotating main body.

Further, where the rotating body is arranged so as to adjust a quantity of air flowing through the conduction holes, it is possible to adjust a negative pressure degree inside the device. That is, a winding tensile force imparted to a target substance can be adjusted to impart the winding tensile force appropriately in accordance with the width and thickness of the target substance.

Further, where the intermediate cylinder portion formed in a substantially cylindrical shape which is installed between the conduction groove and the outer layer portion and also on which the plurality of ventilation holes are formed, is provided, it is possible to exert a negative pressure developed by the conduction groove on the outer layer portion through the plurality of ventilation holes. Thereby, the negative pressure can be efficiently developed at the outer layer portion.

Further, where the intermediate cylinder portion is provided with at least one ventilation hole groove portion which is formed in a radial direction at the center of the ventilation hole, air around the ventilation hole is sucked to widen a region which develops a negative pressure. Thereby, it is possible to further increase a negative pressure degree inside the device.

Further, where the rotating main body is formed substantially in a cylindrical shape, the plurality of conduction holes are formed in the circumferential direction of the rotating main body and the plurality of conduction grooves are formed in the longitudinal direction of the rotating main body, it is possible to exert a negative pressure continuously on a target substance in contact with the rotating device. That is, an adsorption force is continuously developed on the surface of the rotating body by the negative pressure.

Further, where the rotating main body is formed substantially in a cylindrical shape, the plurality of conduction holes are formed in the circumferential direction of the rotating main body, a fixed interval is kept between the conduction holes which are adjacent to each other, the plurality of conduction grooves are formed in the longitudinal direction of the rotating main body, and a fixed interval is kept between the conduction grooves which are adjacent to each other, it is possible to suppress a variation in adsorption force on the surface of the device. That is, the adjacent conduction holes are not communicatively connected to the adjacent conduction grooves. Thereby, it is possible to suppress a state in which only air close to the suction device is sucked and also to impart a uniform negative pressure to an end portion of the rotating main body.

Further, where the rotating body is such that the conduction holes are substantially equal to the conduction grooves in total cross sectional area, a phenomenon in which air is sucked from a place close to the conduction hole is less likely to take place. Thus, it is possible to impart a uniform negative pressure to all the conduction grooves. That is, it is possible to suppress a variation in adsorption force on the surface of the device. In addition, the total cross sectional area is an area obtained by adding all cross sections of faces which are substantially perpendicular to the surface of the device.

Further, where the outer layer portion is formed with a non-woven fabric low in breathability, the outer layer portion can be easily adjusted for air permeability. That is, where there is a desire for increasing a negative pressure degree inside the device, a non-woven fabric extremely low in breathability may be used or a plurality of non-woven fabrics may be overlaid to make a multi-layered structure.

Further, where the outer layer portion is formed with a non-woven fabric low in breathability, the outer layer portion can be easily exchanged on occurrence of smears and clogging on the surface of the non-woven fabric. As a result, maintenance of the device can be facilitated.

Further, where the outer layer portion is at 0.2 $cm^3/cm^2 \cdot s$ or less in air permeability measured by a Frazier type air permeability tester, the outer layer portion is less likely to suck extra external air. As a result, a negative pressure degree inside the device is sufficiently high, thus making it possible to impart a winding tensile force to a target substance sufficiently.

Further, in order to achieve the above-described object, the suction roll device of the present invention is provided with a rotating body which has a rotating main body which is arranged so as to rotate freely, a conduction hole which is installed inside the rotating main body and at which a negative pressure is developed by a predetermined suction device and a conduction groove which is formed on the surface of the rotating main body and connected to the conduction hole, a driver which rotates the rotating main body, and an elastic outer layer portion low in breathability which is formed outside all the conduction grooves and has a friction coefficient higher than a predetermined value.

Here, the rotating body is provided with the conduction hole at which a negative pressure is developed by a predetermined suction device and the conduction groove which is formed on the surface of the rotating main body and also connected to the conduction hole. Thereby, the negative pressure is exerted on an object in contact with the surface of the rotating main body and the object can be adsorbed. In addition, at this time, the object in contact with the surface is, for example, a wide sheet-like product formed with paper, resin or the like.

Still further, there is provided the rotating body which has the rotating main body which is arranged so as to rotate freely, the conduction hole which is installed inside the rotating main body and at which a negative pressure is formed by a predetermined suction device and the conduction groove which is formed on the surface of the rotating main body and connected to the conduction hole. Thereby, rotation of the rotating main body can be utilized to deliver a sheet-like product adsorbed on the surface of the device. That is, it is possible to grip and convey the sheet-like product.

In addition, there is provided the driver for rotating the rotating main body, thus making it possible to rotate the rotating main body independently. Thereby, it is possible to reliably convey a sheet-like product.

Effects of the Invention

The suction roll device of the present invention is able to sufficiently grip and convey or control a variety of long materials without damaging them and also able to reliably wind them up.

BEST MODE FOR CARRYING OUT THE INVENTION

Hereinafter, a description will be given of an embodiment of the present invention by referring to drawings for the purpose of understanding the present invention.

Figure 1:
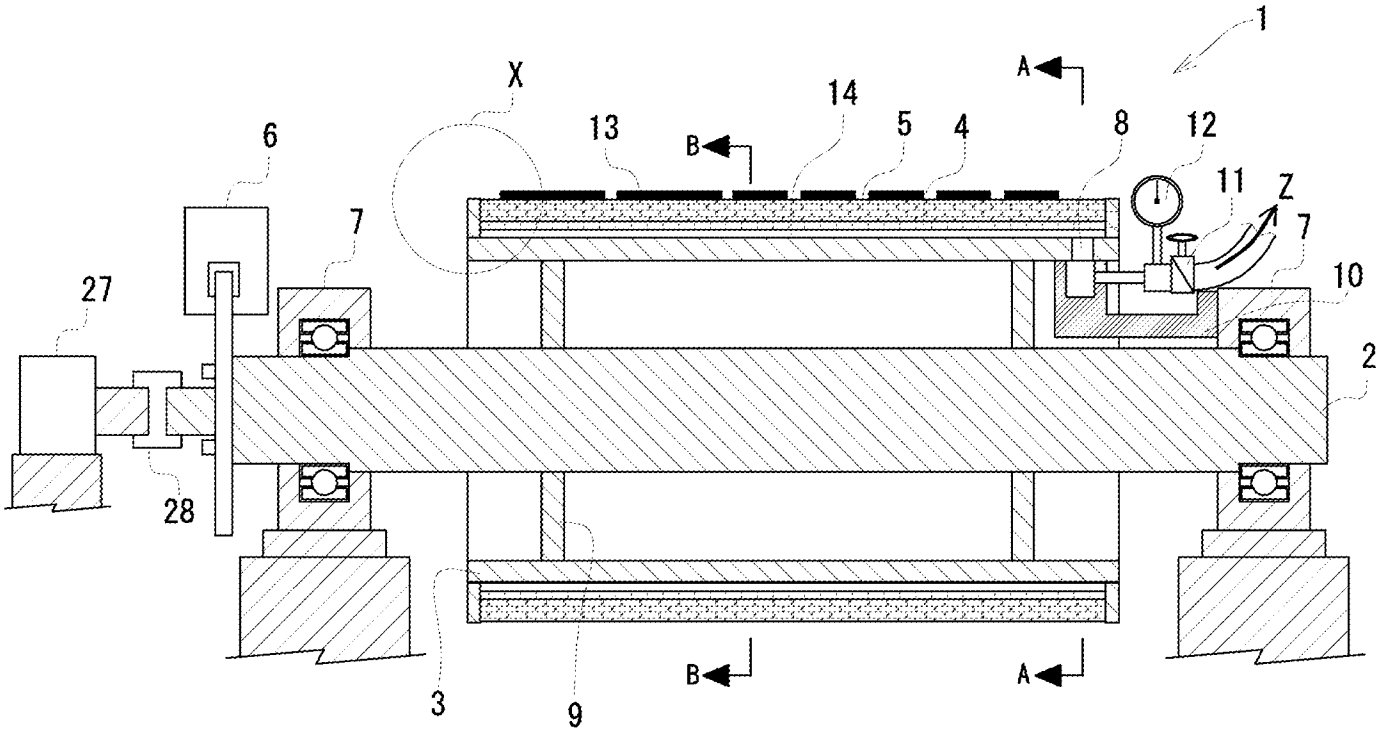
FIG. 1 is a schematic diagram which shows one example of a suction roll device to which the present invention has been applied.
Figure 2:
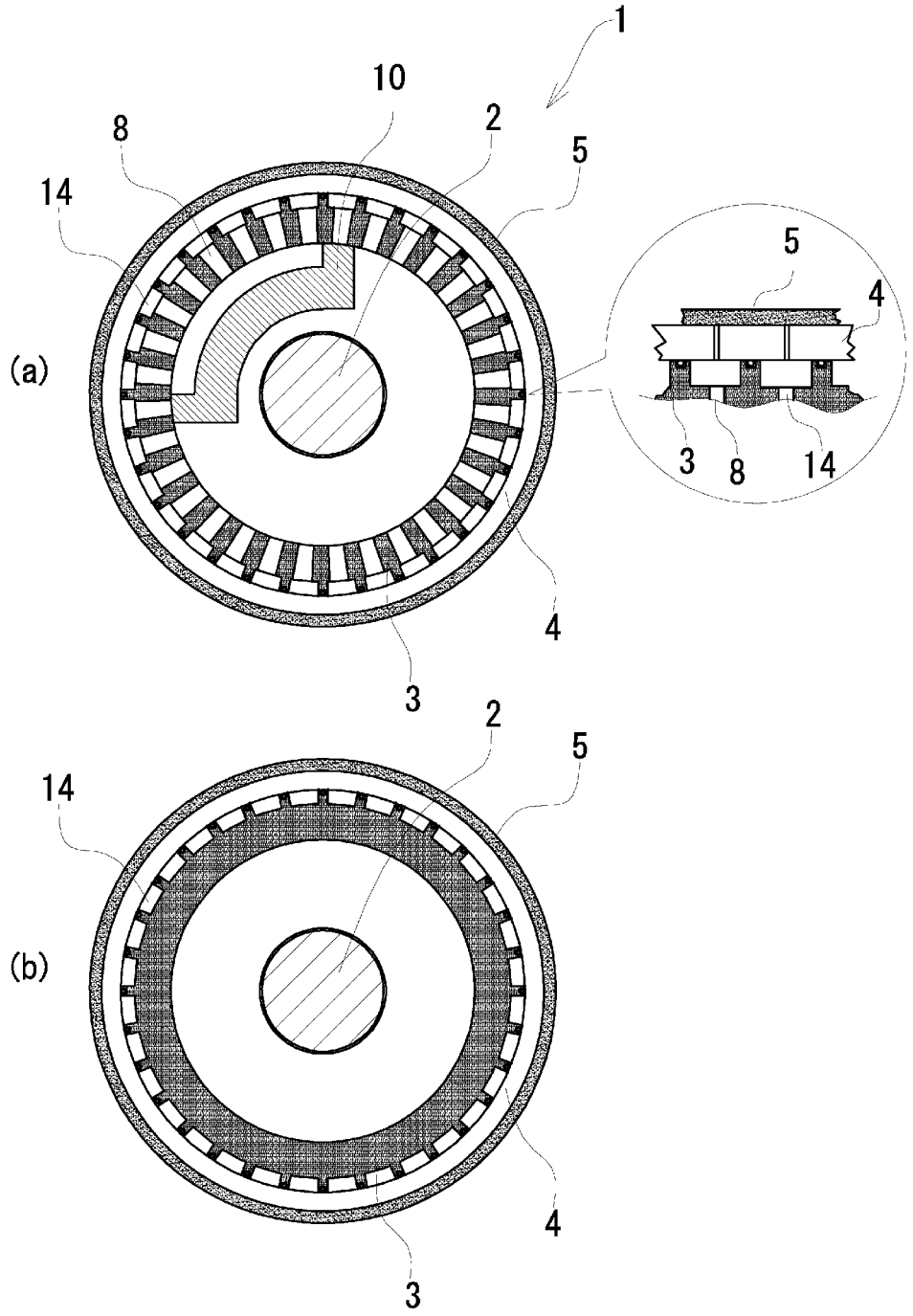
FIG. 2(*a*) is a cross sectional view taken along the line A-A shown in the schematic diagram of FIG. 1, and FIG. 2(*b*) is a cross sectional view taken along the line B-B.
Figure 3:
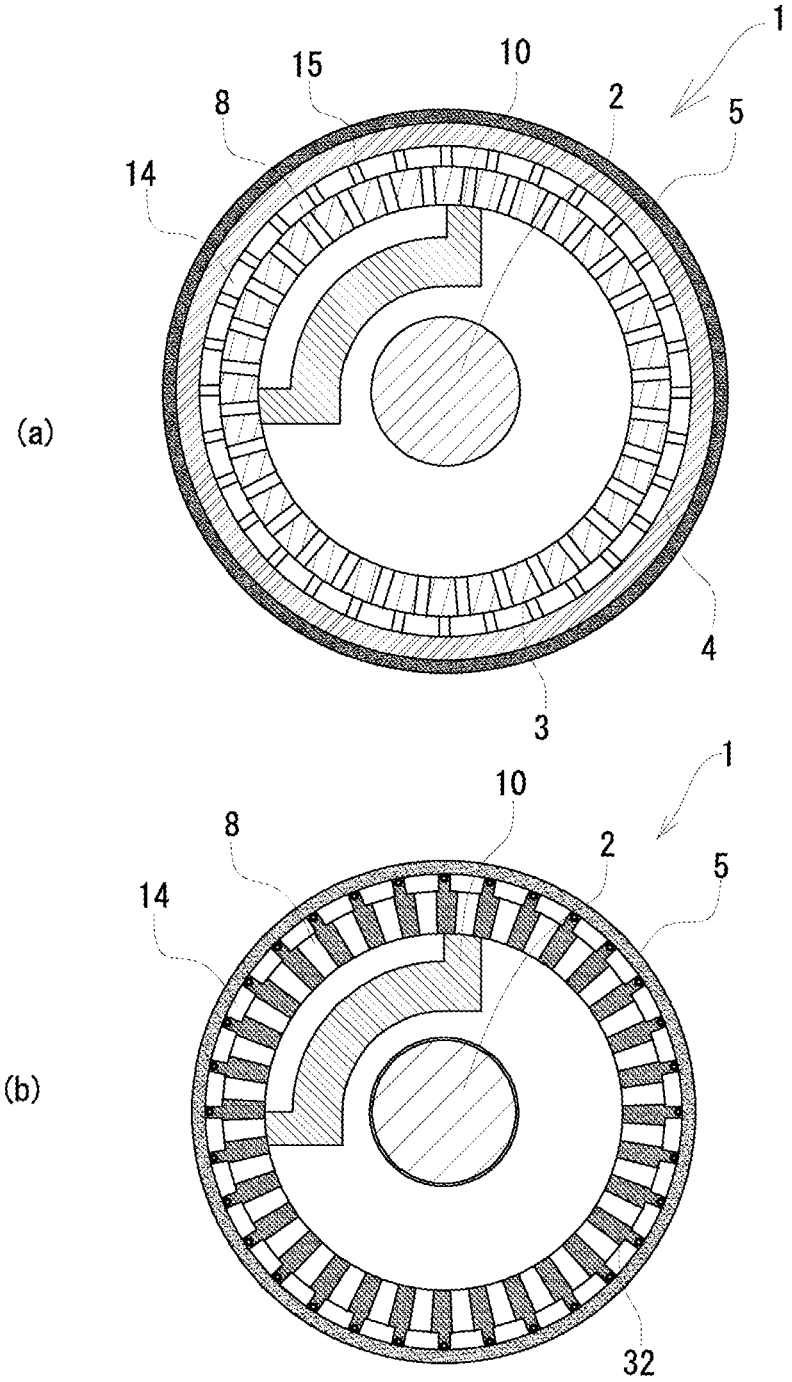
FIG. 3(*a*) is a schematic cross sectional view which shows a position corresponding to another example of a negative pressure conduction portion of the suction roll device, and FIG. 3(*b*) is a schematic cross sectional view which shows a position corresponding to still another example of the negative pressure conduction portion of the suction roll device.
Figure 4:
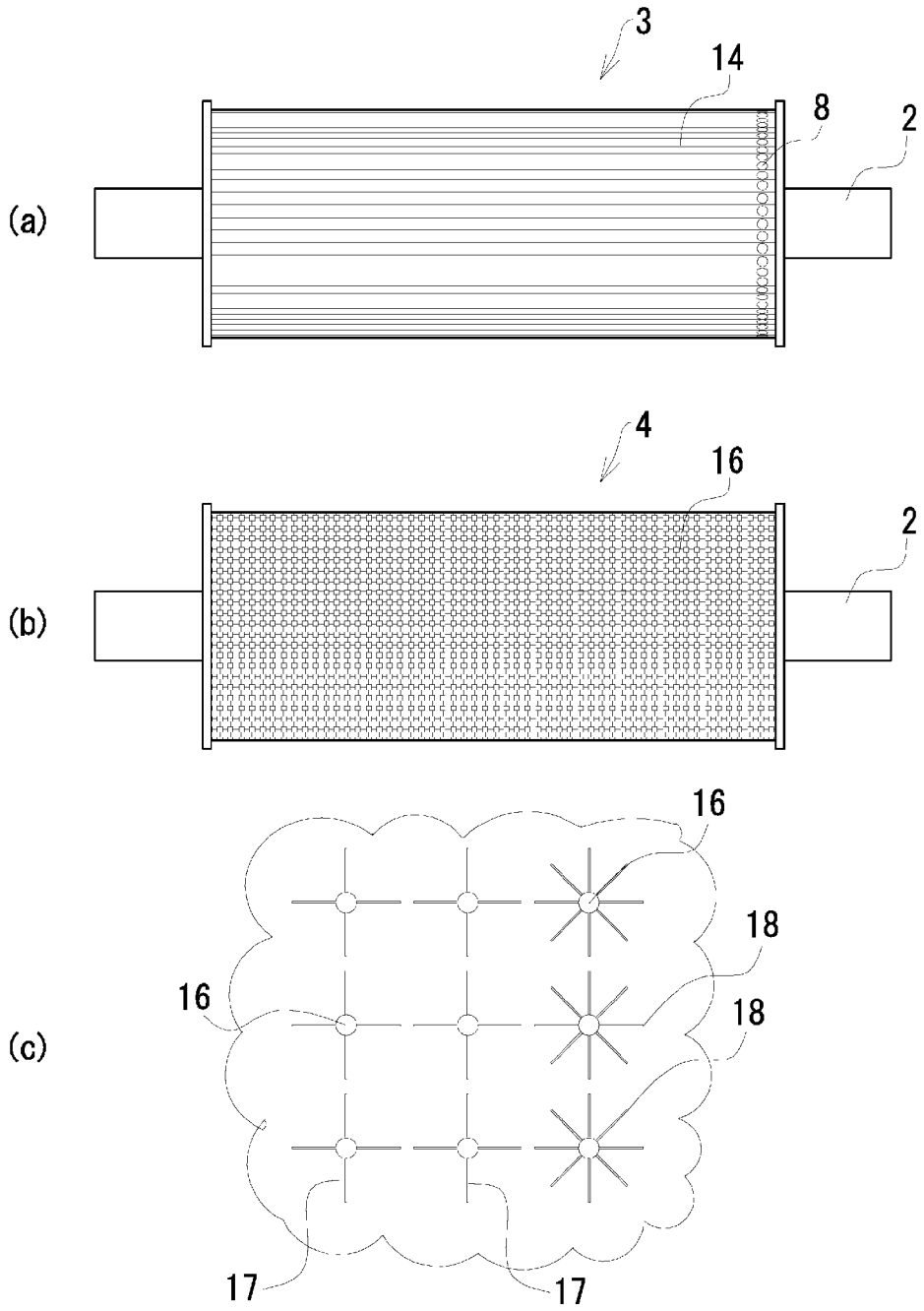
FIG. 4(*a*) is a schematic diagram which shows an internal cylinder, FIG. 4(*b*) is a schematic diagram which shows an intermediate cylinder, and FIG. 4(*c*) is a schematic diagram which shows ventilation hole groove portions installed around ventilation holes.
Figure 5:
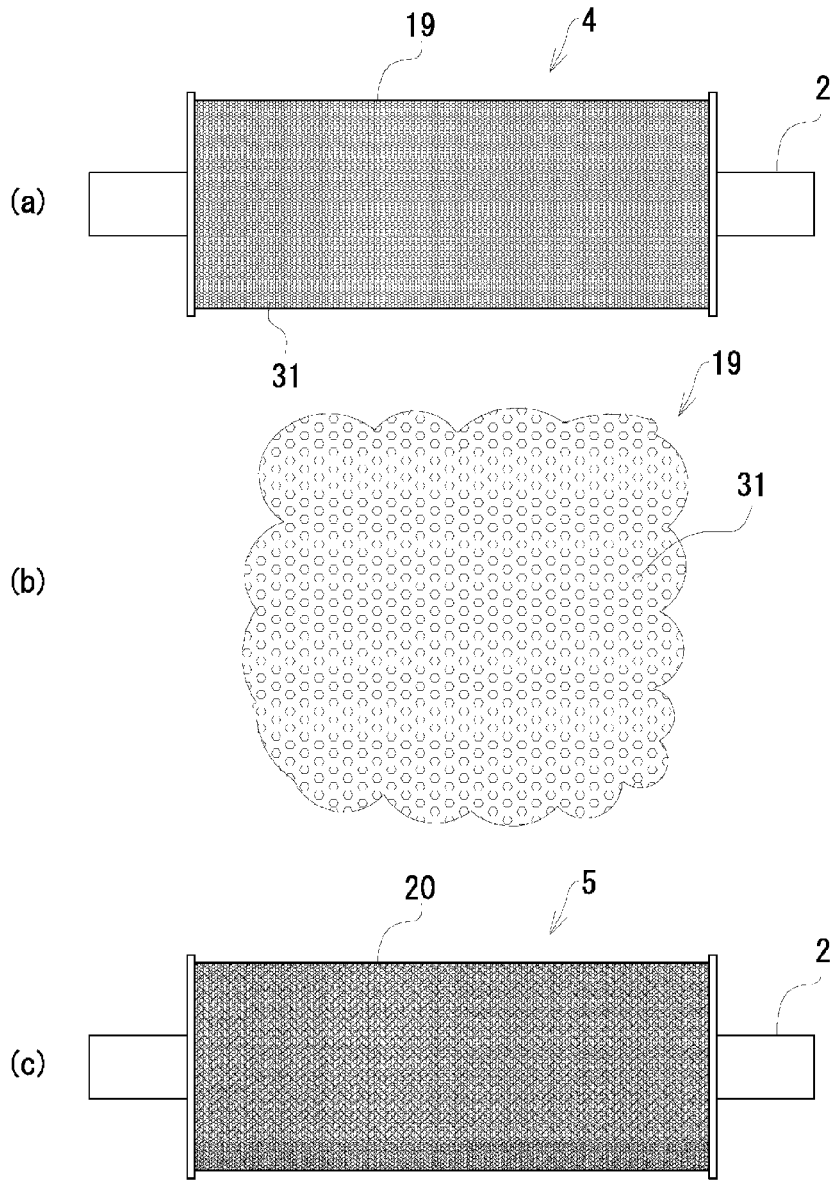
FIG. 5(*a*) is a schematic diagram which shows the intermediate cylinder using a perforated metal, FIG. 5(*b*) is a schematic diagram which shows many small-diameter holes of the perforated metal, and FIG. 5(*c*) is a schematic diagram which shows a multi-layered non-woven fabric laminated external cylinder.
Figure 6:
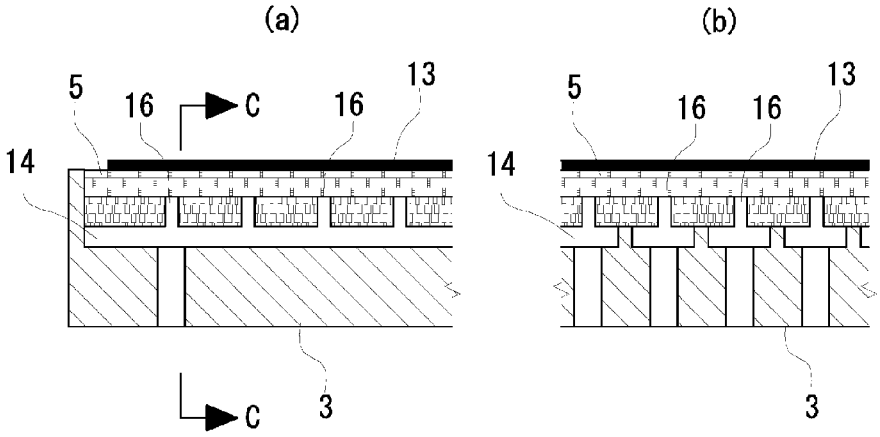
FIG. 6(*a*) is a cross sectional view which shows the details of an X part of FIG. 1, and FIG. 6(*b*) is a cross sectional view taken along the line C-C in the cross sectional view, FIG. 6(*a*).
Figure 7:
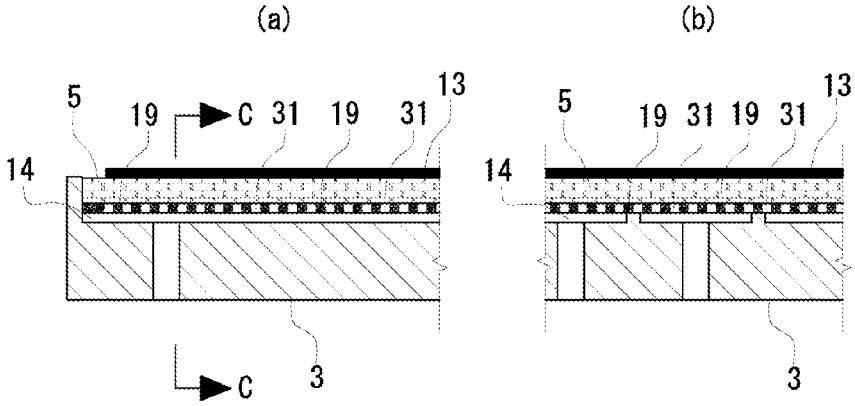
FIG. 7(*a*) is a cross sectional view which corresponds to FIG. 6(*a*) showing another example of the suction roll device, and FIG. 7(*b*) is a cross sectional view which corresponds to FIG. 6(*b*).
Figure 8:
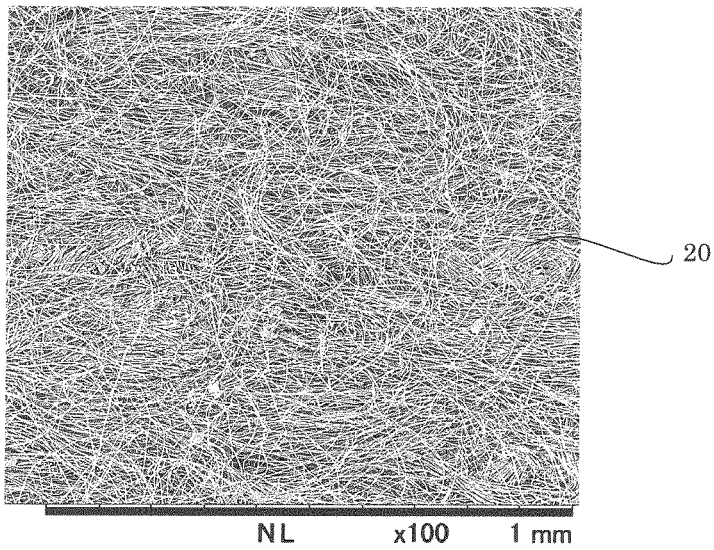
FIG. 8 is a drawing which shows an enlarged microphotograph of a non-woven fabric used in the suction roll device to which the present invention has been applied.
Figure 9:
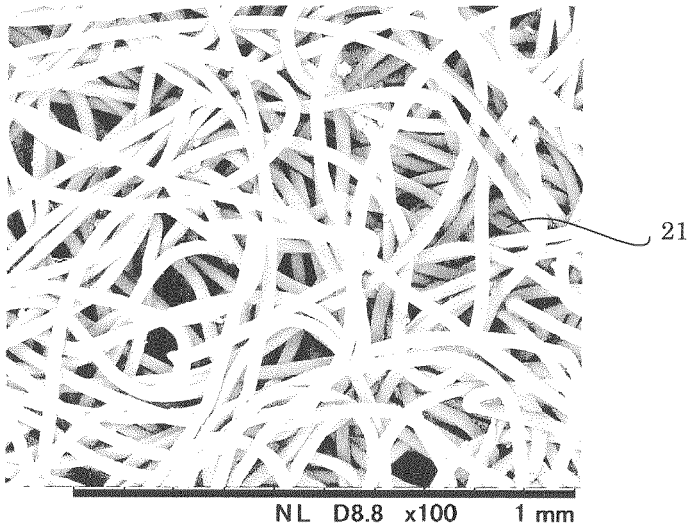
FIG. 9 is a drawing which shows an enlarged microphotograph of a generally used non-woven fabric.
Figure 10:
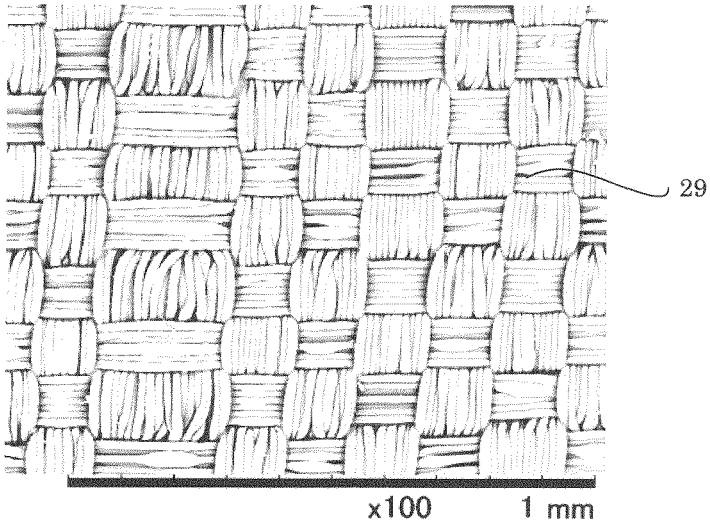
FIG. 10 is a drawing which shows an enlarged microphotograph of a high-density woven fabric.
Figure 11:
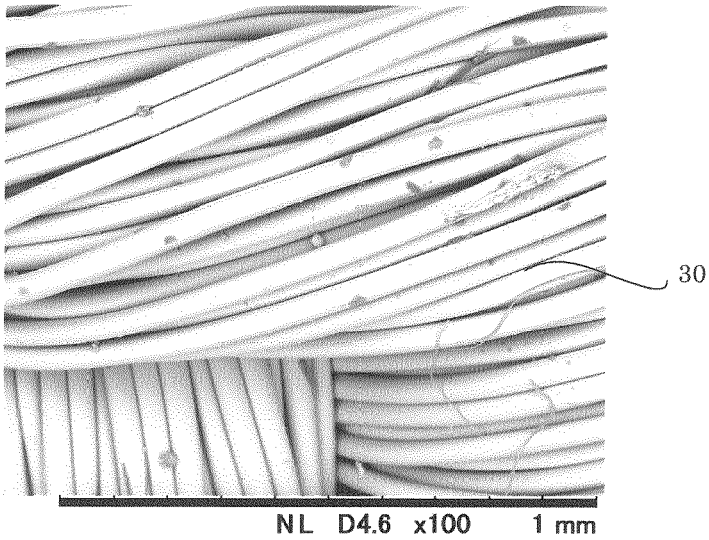
FIG. 11 is a drawing which shows an enlarged microphotograph of a generally used woven fabric.

FIG. 1 is a schematic diagram which shows one example of the suction roll device to which the present invention has been applied. FIG. 2(*a*) is a cross sectional view taken along the line A-A, and FIG. 2(*b*) is a cross sectional view taken along the line B-B in the schematic diagram of FIG. 1. FIG. 3(*a*) is a schematic cross sectional view which shows a position corresponding to another example of a negative pressure conduction portion of the suction roll device, and FIG. 3(*b*) is a schematic cross sectional view which shows a position corresponding to still another example of the negative pressure conduction portion of the suction roll device. FIG. 4(*a*) is a schematic diagram which shows an internal cylinder, FIG. 4(*b*) is a schematic diagram which shows an intermediate cylinder, and FIG. 4(*c*) is a schematic diagram which shows ventilation hole groove portions installed around ventilation holes. FIG. 5(*a*) is a schematic diagram which shows an intermediate cylinder using a perforated metal, FIG. 5(*b*) is a schematic diagram which shows many small-diameter holes of the perforated metal, and FIG. 5(*c*) is a schematic diagram which shows a multi-layered non-woven fabric laminated external cylinder. FIG. 6(*a*) is a cross sectional view which shows the details of an X part in FIG. 1, and FIG. 6(*b*) is a cross sectional view taken along the line C-C in the cross sectional view, FIG. 6(*a*). FIG. 7(*a*) is a cross sectional view which corresponds to FIG. 6(*a*) which is another example of the suction roll device, and FIG. 7(*b*) is a cross sectional view which corresponds to FIG. 6(*b*). FIG. 8 is a drawing which shows an enlarged microphotograph of a non-woven fabric used in the suction roll device to which the present invention has been applied. FIG. 9 is a drawing which shows an enlarged microphotograph of a generally used non-woven fabric. FIG. 10 is a drawing which shows an enlarged microphotograph of a high-density woven fabric. FIG. 11 is a drawing which shows an enlarged microphotograph of a generally used woven fabric.

Here, as shown in FIG. 1, a negative pressure roll 1 which is one example of the suction roll device to which the present invention has been applied is provided with a rotating shaft 2, an internal cylinder 3, an intermediate cylinder 4 and a multi-layered non-woven fabric laminated outer layer 5.

Further, the rotating shaft 2 is a member which is the center of rotation of the negative pressure roll 1 and connected to the internal cylinder 3 by way of a reinforcement circular disk 9. Still further, the internal cylinder 3 is formed in a cylindrical shape and rotates together with the rotating shaft 2. In addition, the rotating shaft 2 and the internal cylinder 3 correspond to the rotating main body.

Further, the intermediate cylinder 4 is a cylindrical tubular material formed outside the internal cylinder 3 and rotates in association with the rotating shaft 2 and the internal cylinder 3. Still further, the multi-layered non-woven fabric laminated outer layer 5 is formed outside the intermediate cylinder 4 and made as a part at which the negative pressure roll 1 is in contact with a metal strip 13. The multi-layered non-woven fabric laminated outer layer 5 also rotates in association with the rotating shaft 2, the internal cylinder 3 and the intermediate cylinder 4.

Further, the negative pressure roll 1 is provided with a controller 6 which suppresses rotation of the negative pressure roll 1. Still further, the negative pressure roll 1 is provided with a bearing 7 which supports the rotating shaft 2 on each side of the rotating shaft 2.

At this time, the negative pressure roll 1 is not necessarily composed of the rotating shaft 2, the internal cylinder 3, the intermediate cylinder 4 and the multi-layered non-woven fabric laminated outer layer 5. However, from a viewpoint that the roll is divided into each individual member to facilitate manufacture and maintenance, it is preferable that the negative pressure roll 1 is composed of the rotating shaft 2, the internal cylinder 3, the intermediate cylinder 4 and the multi-layered non-woven fabric laminated outer cylinder 5.

Further, the rotating main body is not necessarily composed of the rotating shaft 2, the internal cylinder 3 and the reinforcement circular disk 9. However, from a viewpoint that there can be provided strength for withstanding a tensile force upon imparting a great winding tensile force to a metal strip, it is preferable that the rotating main body is composed of the rotating shaft 2, the internal cylinder 3 and the reinforcement circular disk 9. Still further, where the rotating shaft 2, the internal cylinder 3 and the reinforcement circular disk 9 are integrally formed with the same metal to further increase strength, this is more preferable. In addition, in a relatively small-sized device, it is acceptable that the internal cylinder 3 is not formed in a cylindrical shape but a solid material is machined to make the negative pressure roll 1 which is integrated with the rotating shaft 2.

Further, materials of the rotating shaft 2 and the internal cylinder 3 are not particularly restricted. For example, a plastic material can be used to lower manufacturing costs.

Further, a member of each of the rotating shaft 2, the internal cylinder 3, the intermediate cylinder 4 and the multi-layered non-woven fabric laminated outer layer 5 is not in particular restricted in structure. Any structure will suffice as long as each individual member is allowed to rotate integrally in the same direction. That is, it is acceptable to adopt such a structure that each member is coupled with each other by using a fixture or such a structure that each member is allowed to rotate integrally by frictional engagement derived from a frictional force between the individual members.

Still further, a type of the bearing 7 is not particularly restricted. For example, a ball bearing may be used as the bearing 7. However, it is preferable to adopt an anti-friction bearing and a sliding bearing as the bearing 7 because it is possible to rotate the shaft smoothly and improve the durability of the device.

In addition, a structure or type of the controller 6 is not particularly restricted. Any controller may be used sufficiently as long as it is possible to suppress rotation of the negative pressure roll 1. The controller 6 includes, for example, a disk brake, a water-cooling pneumatic brake, an electric motor brake and a hydraulic brake.

As shown in FIG. 1, the negative pressure roll 1 is provided with an electric motor 27. The electric motor 27 is connected to the rotating shaft 2 by way of a detachable joint 28 so as to be attached in a detachable manner and rotates the rotating main body.

At this time, the negative pressure roll 1 is not necessarily provided with the electric motor 27. However, the negative pressure roll 1 is able to convey the metal strip 13 to a winding machine by actuating the electric motor 27 after adsorbing and gripping at a negative pressure the metal strip 13 after slit processing. And, the negative pressure roll 1 can also be used in a line of processing sheet-like products formed with paper, resin and the like as a suction roll for gripping and conveying the product. It is, therefore, preferable that the negative pressure roll 1 is provided with the electric motor 27.

Further, the electric motor 27 is not necessarily connected to the rotating shaft 2 so as to be attached in a detachable manner by way of the detachable joint 28. However, a driving force can be quickly switched between transmission to the rotating main body and halt thereof. Therefore, it is preferable that the electric motor 27 is connected to the rotating shaft 2 so as to be attached in a detachable manner by way of the detachable joint 28.

As shown in FIG. 1, a negative pressure conduction hole 8 which penetrates through the internal cylinder 3 is formed at one end of the internal cylinder 3. The negative pressure conduction hole 8 acts as a flow path of air when the air inside the negative pressure roll 1 is sucked by using a vacuum pump. Further, a plurality of negative pressure conduction holes 8 are formed, with a fixed interval kept, in the circumferential direction of the internal cylinder 3. In addition, an arrow Z indicates a direction in which the negative pressure roll 1 is sucked by the vacuum pump.

Further, in the present invention, it is not necessary to use, as the suction device, a large-capacity discharge blower which has been used in prior art of the suction roll device. The back side of the metal strip 13 in contact with the negative pressure roll 1 is kept at a negative pressure to develop an adsorption force derived from atmospheric pressing, thus making it possible to use a vacuum pump or an ejector which is relatively small in sucking capacity but able to produce high vacuum.

Further, a negative pressure conduction groove 14 connected to the negative pressure conduction hole 8 is installed on the surface of the internal cylinder 3. The negative pressure conduction grooves 14 are formed over the longitudinal direction of the negative pressure roll 1, thereby developing a negative pressure up to an end portion of the negative pressure roll 1.

Further, a negative pressure conduction portion 10 is installed on the side of the rotating shaft 2 of the negative pressure roll 1 so as to be communicatively connected to the negative pressure conduction hole 8. The negative pressure conduction portion 10 is linked with the vacuum pump, acting as an inlet port for keeping the inside of the negative pressure roll 1 at a negative pressure.

Still further, the negative pressure conduction portion 10 is fixed by being connected to the bearing 7, thereby increasing airtightness inside the negative pressure roll 1 while being in contact with the negative pressure conduction hole 8 which rotates together with the rotating shaft 2.

In addition, a negative pressure adjusting valve 11 and a negative pressure gauge 12 are installed so as to be connected to the negative pressure conduction portion 10. The negative pressure adjusting valve 11 is a valve which adjusts a quantity of air flowing through the negative pressure conduction portion 10.

At this time, the negative pressure conduction hole 8 will suffice as long as it is possible to develop a negative pressure inside the negative pressure roll 1, and the number of the negative pressure conduction holes 8 and a position at which the negative pressure conduction hole is formed are not particularly restricted. However, from a viewpoint of continuously imparting a negative pressure to the rotating negative pressure roll 1, it is preferable that the negative pressure conduction holes 8 are arrayed, with an equal interval kept, in the circumferential direction of the internal cylinder 3.

Further, the negative pressure conduction hole 8 is not necessarily formed only at one end of the internal cylinder 3. For example, in the case of a long negative pressure roll, such an arrangement is acceptable in which the negative pressure conduction hole 8 and a flow path of the vacuum pump are installed on each side of the internal cylinder 3 to suck internal air from both end portions of the negative pressure roll 1.

Further, the negative pressure conduction portion 10 is not necessarily provided. Such a structure will suffice as long as it is possible to develop a negative pressure inside the negative pressure roll 1 or other publicly known technology may be used. However, from a viewpoint of increasing the airtightness inside the negative pressure roll 1, it is preferable that the negative pressure conduction portion 10 is provided.

Further, the negative pressure conduction portion 10 is not necessarily connected to the bearing 7. However, from a viewpoint that the negative pressure conduction portion 10 is fixed to easily increase the airtightness between the negative pressure conduction portion 10 and the negative pressure conduction hole 8, it is preferable that the negative pressure conduction portion 10 is connected to the bearing 7.

Further, the negative pressure adjusting valve 11 or the negative pressure gauge 12 is not necessarily installed on the negative pressure roll 1. However, from a viewpoint of a structure which enables confirmation of a negative pressure inside the roll and easy control of the negative pressure, it is preferable that the negative pressure adjusting valve 11 and the negative pressure gauge 12 are installed on the negative pressure roll 1.

One end of the negative pressure roll 1 has a cross section which is shown in FIG. 2(*a*). The negative pressure conduction portion 10 and the negative pressure conduction hole 8 are installed at one end of the negative pressure roll 1. The negative pressure conduction portion 10 is formed at a region which accounts for an approximately 90-degree section on the circumference of the negative pressure roll. The negative pressure roll 1 is arranged so as to be in contact with the metal strip 13 at a position corresponding to the negative pressure conduction portion 10. In addition, the drawing on the right side of FIG. 2(*a*) is a drawing which enlarges a surface region of the negative pressure roll 1.

Further, as shown in FIG. 2(*b*), at a region spaced away from one end of the negative pressure roll 1, the negative pressure roll 1 is composed of the internal cylinder 3, the negative pressure conduction groove 14, the intermediate cylinder 4 and the multi-layered non-woven fabric laminated outer layer 5.

At this time, the negative pressure conduction portion 10 is not necessarily formed at a region which accounts for an approximately 90-degree section on the circumference of the negative pressure roll. However, from a standpoint that the negative pressure roll can be arrayed so as to come into contact with a metal strip which rises from below in a perpendicular direction and thereafter pull the metal strip in a horizontal direction by which the negative pressure roll 1 can be easily arrayed on an existing slitter line, it is preferable that the negative pressure conduction portion 10 is formed at a region which accounts for an approximately 90-degree section on the circumference of the negative pressure roll.

FIG. 3(*a*) is a drawing which shows a structure of another example of the suction roll device. The suction roll device shown here is different from the device shown in FIG. 1 and FIG. 2 in that a partition projection 15 is installed on the surface of the internal cylinder 3 to form the negative pressure conduction groove 14 between the partition projections 15. As described above, it is also possible to form the negative pressure conduction groove 14 as a layer different from the internal cylinder 3.

Further, the partition projection 15 which is prepared by using an elastic material such as soft rubber having appropriate hardness can be firmly attached to the internal cylinder 3 and the intermediate cylinder 4. Therefore, the negative pressure conduction groove 14 can be increased in airtightness.

Further, FIG. 3(*b*) is a drawing which shows a structure of still another example of the suction roll device. The device shown in FIG. 3(*b*) is structured so as to be devoid of the intermediate cylinder 4. The device shown in FIG. 3(*b*) is also provided with the rotating main body 32. The above-described simplified structure may be adopted if a negative pressure can be exerted on a metal strip.

As shown in FIG. 4(*a*), the internal cylinder 3 is provided with the plurality of negative pressure conduction holes 8 and the plurality of negative pressure conduction grooves 14. The right side of the internal cylinder 3 in FIG. 4(*a*) is one end of the negative pressure roll 1. The internal cylinder is structured so that upon actuation of the vacuum pump, a negative pressure is developed at the negative pressure conduction holes 8 and the negative pressure conduction grooves 14 as well by way of the negative pressure conduction portion 10. The negative pressure is developed through the negative pressure conduction grooves 14 up to an end portion opposite to a side where the negative pressure conduction holes 8 are installed.

Further, as shown in FIG. 4(*b*), the intermediate cylinder 4 is installed outside the internal cylinder 3. The intermediate cylinder 4 is formed with a tubular material made of a metal, synthetic resin or hard rubber, and many ventilation holes 16 are provided on the surface of the intermediate cylinder 4. The ventilation holes 16 are positioned, with a fixed interval kept, in the longitudinal direction of the intermediate cylinder 4 and in the circumferential direction thereof as well. Air flows through the ventilation hole 16 to the negative pressure conduction grooves 14 to develop a negative pressure.

Further, ventilation hole groove portions 17 formed in four directions are installed around the ventilation hole 16. The ventilation hole groove portions 17 spread the air sucked into the ventilation holes 16 to a wider range.

Further, all cross sectional areas of the negative pressure conduction holes 8 are formed so as to be substantially equal to all cross sectional areas of the negative pressure conduction grooves 14. All cross sectional areas of the negative pressure conduction holes 8 are also formed so as to be substantially equal to all cross sectional areas of the ventilation holes 16.

At this time, the intermediate cylinder 4 or the ventilation holes 16 are not necessarily formed. Any arrangement will suffice as long as it is possible to exert a negative pressure on a metal strip. However, from a viewpoint that the intermediate cylinder 4 is formed and the ventilation holes 16 are installed, thus making it possible to efficiently develop a negative pressure on the multi-layered non-woven fabric outer layer 15, it is preferable that the intermediate cylinder 4 and the ventilation holes 16 are installed.

Further, the ventilation hole groove portions 17 are not necessarily installed around the ventilation hole 16. However, from a viewpoint that a region of developing a negative pressure is spread to further increase a negative pressure degree inside the negative pressure roll 1, it is preferable that the ventilation hole groove portions 17 are installed around the ventilation hole 16. In addition, the shape of the ventilation hole groove portion is not particularly restricted. As shown in FIG. 4(*c*), the number of grooves may be increased to make ventilation hole groove portions 18 which are formed in eight directions as well.

Further, all cross sectional areas of the negative pressure conduction holes 8 are not necessarily formed so as to be substantially equal to all cross sectional areas of the negative pressure conduction grooves 14. However, from a viewpoint of developing a uniform negative pressure entirely on the negative pressure roll 1, it is preferable that all cross sectional areas of the negative pressure conduction holes 8 are formed so as to be substantially equal to all cross sectional areas of the negative pressure conduction grooves 14. From a similar point of view, it is more preferable that all cross sectional areas of the negative pressure conduction holes 8 are formed so as to be substantially equal to all cross sectional areas of the ventilation holes 16.

FIG. 5(*a*) shows the intermediate cylinder 4 which is formed with a perforated metal 19 as another example of the intermediate cylinder 4. The perforated metal 19 is a material obtained by punching a flat metal strip to form many small-diameter holes 31. FIG. 5(*b*) shows the small diameter holes 31 formed on the perforated metal 19. The small diameter hole 31 is a hole which allows air to flow through the negative pressure conduction groove 14, as with the ventilation hole 16, and is smaller than the ventilation hole 16. In addition, the perforated metal 19 is commercially available.

Further, a perpendicular cross-sectional area of one array of the negative pressure conduction grooves 14 is formed so as to be substantially equal to a total hole area of small diameter holes 31 of the perforated metal on the negative pressure conduction grooves 14. It is, thereby, possible to develop a uniform negative pressure entirely at the negative pressure roll 1.

As shown in FIG. 5(*c*), the multi-layered non-woven fabric laminated outer layer 5 is installed outside the intermediate cylinder 4. The multi-layered non-woven fabric laminated outer layer 5 is formed by overlaying a plurality of non-woven fabrics 20 low in breathability, with air permeability measured by a Frazier type air permeability tester being 0.2 $cm^3/cm^2 \cdot s$ or less. Further, the non-woven fabric 20 is provided with an appropriate friction coefficient and elasticity, and the non-woven fabric 20 develops a sufficient frictional force between itself and the metal strip 13, and is not damaged when in contact with the metal strip.

At this time, the multi-layered non-woven fabric laminated outer layer 5 is not necessarily formed by overlaying a plurality of non-woven fabrics 20 low in breathability. Any outer layer will suffice as long as it is possible to exert a negative pressure on the metal strip. However, from a viewpoint of easily adjusting air permeability of the outer layer portion, it is preferable that the multi-layered non-woven fabric laminated outer layer 5 is formed by overlaying a plurality of non-woven fabrics 20 low in breathability.

Further, the multi-layered non-woven fabric laminated outer layer 5 is not necessarily at 0.2 $cm^3/cm^2 \cdot s$ or less in air permeability measured by a Frazier type air permeability tester. Any air permeability will suffice as long as it is possible to exert a negative pressure on the metal strip. However, from a viewpoint that a negative pressure degree inside the negative pressure roll is increased to impart a sufficient winding tensile force to the metal strip, it is preferable that the multi-layered non-woven fabric laminated outer layer 5 is at 0.2 $cm^3/cm^2 \cdot s$ or less in air permeability measured by a Frazier type air permeability tester. In addition, the air permeability is restricted so that a negative pressure is exerted effectively on the surface of the multi-layered non-woven fabric laminated outer layer 5 where the negative pressure roll 1 is long. In the case of a negative pressure roll 1 which is relatively short, it is acceptable that the multi-layered non-woven fabric laminated outer layer 5 is at about 0.5 $cm^3/cm^2 \cdot s$ in air permeability measured by a Frazier type air permeability tester.

FIG. 6(*a*) shows the details of an X part of the negative pressure roll shown in FIG. 1. The negative pressure conduction groove 14 is formed on the surface of the internal cylinder 3, and the ventilation holes 16 of the intermediate cylinder 4 are positioned, with a fixed interval kept. Further, the multi-layered non-woven fabric laminated outer layer 5 is formed outside the ventilation holes 16, and the metal strip 13 is structurally in contact with the non-woven fabric. Still further, FIG. 6(*b*) is a cross sectional view which is obtained by viewing the cross sectional view, FIG. 6(*a*), in the direction C-C. In addition, FIG. 6(*b*) is actually formed in a circular-arc shape but shown in a straight line for the sake of convenience.

Further, FIG. 7(*a*) shows the details of the X part of the negative pressure roll, where the intermediate cylinder 4 is formed with a perforated metal 19. The negative pressure conduction groove 14 is formed on the surface of the internal cylinder 3, and the perforated metal 19 is positioned further outside thereof. Still further, the multi-layered non-woven fabric laminated outer layer 5 is formed outside the perforated metal 19, and the metal strip 13 is structurally in contact with the non-woven fabric. In addition, FIG. 7(*b*) is a cross sectional view which is obtained by viewing the cross sectional view, FIG. 7(*a*), in the direction C-C. In addition, FIG. 7(*b*) is actually formed in a circular-arc shape but shown in a straight line for the sake of convenience.

FIG. 8 shows a microphotograph (a magnification of 100 times) of the non-woven fabric 20 used in the negative pressure roll 1. The non-woven fabric 20 is formed by tangling fibers densely with a diameter of about 4 μm. Further, the non-woven fabric 20 is low in air permeability which is about 0.8 $cm^3/cm^2 \cdot s$ per sheet measured by a Frazier type air permeability tester. The plurality of the non-woven fabrics 20 can be overlaid to make the multi-layered non-woven fabric laminated outer layer 5 which is quite low in breathability. Further, the non-woven fabrics 20 is characterized in that many μm-sized clearances are present between individual extremely thin fibers of the non-woven fabric, and a negative pressure can easily arrive entirely on the outer layer 5 through these clearances.

On the other hand, FIG. 9 shows a microphotograph of a non-woven fabric 21 which is generally used in a tension pad of a tension pad-type winding tensile force imparting device. The non-woven fabric 21 is obtained by tangling fibers with a diameter of about 20 to 30 μm and lower in density than the non-woven fabric 20. Further, the non-woven fabric 21 is 50 to 100 $cm^3/cm^2 \cdot s$ per sheet in air permeability measured by a Frazier type air permeability tester. It is, therefore, difficult to use it as a non-woven fabric of the multi-layered non-woven fabric laminated outer layer 5.

However, there is no great difference in friction coefficient between the surface of the non-woven fabric 21 and the surface of the non-woven fabric 20. Therefore, the non-woven fabric 21 may be used in combination with a material which is low in air permeability or about 0.8 $cm^3/cm^2 \cdot s$ measured by using a Frazier type air permeability tester, for example, a high-density woven fabric 29 such as a nylon woven fabric, thereby providing a fabric low in breathability. That is, the high-density woven fabric 29 can be sandwiched between the non-woven fabrics 21 to form the multi-layered non-woven fabric laminated outer layer 5. FIG. 10 shows an enlarged microphotograph (a magnification of 100 times) of the high-density woven fabric 29, and FIG. 11 shows that of a generally used woven fabric 30.

Hereinafter, a description will be given of the above-arranged negative pressure roll 1 which will impart a winding tensile force to a metal strip.

Figure 12:
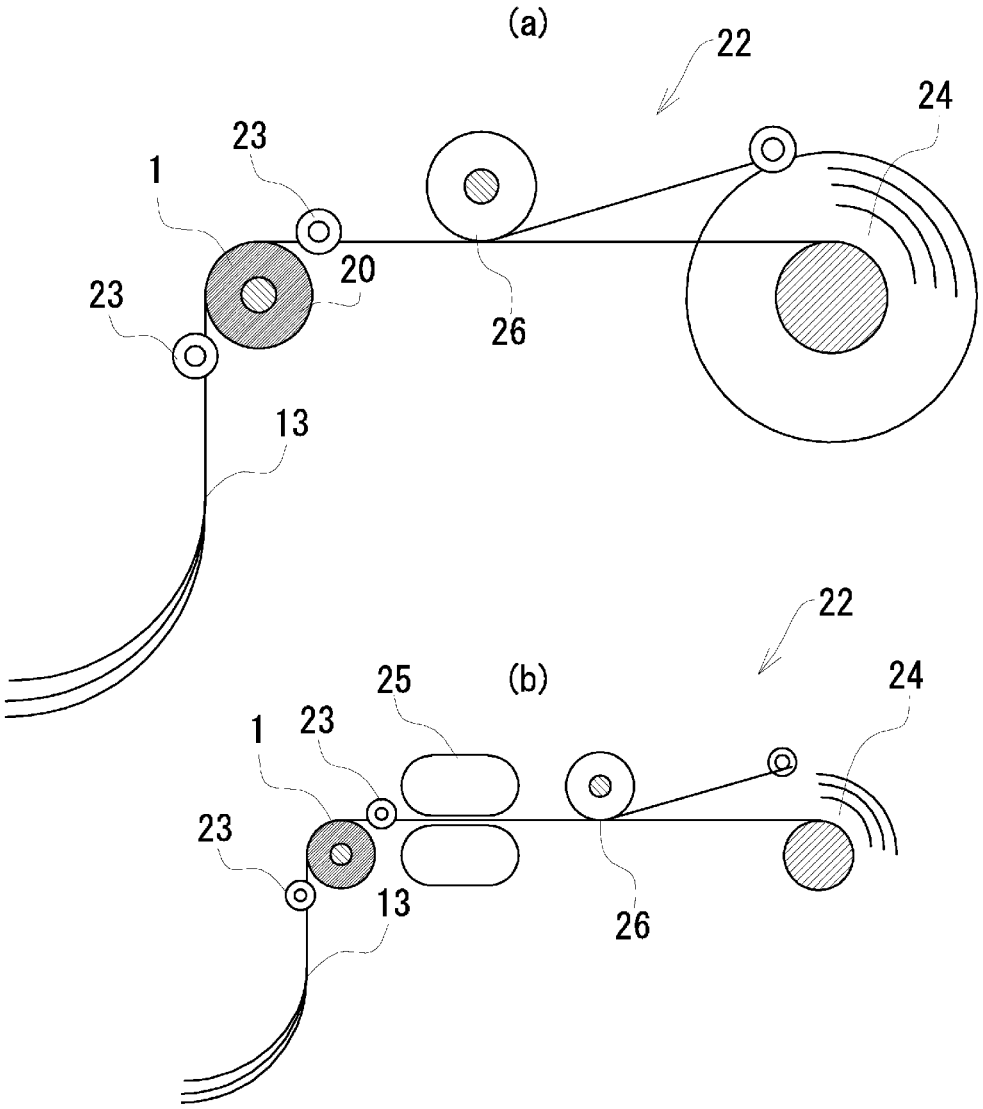
FIG. 12(*a*) is a schematic diagram which shows one example of arraying the suction roll device on a slitter line which is on a winding side, and FIG. 12(*b*) is a schematic diagram which shows another arrangement example.
Figure 13:
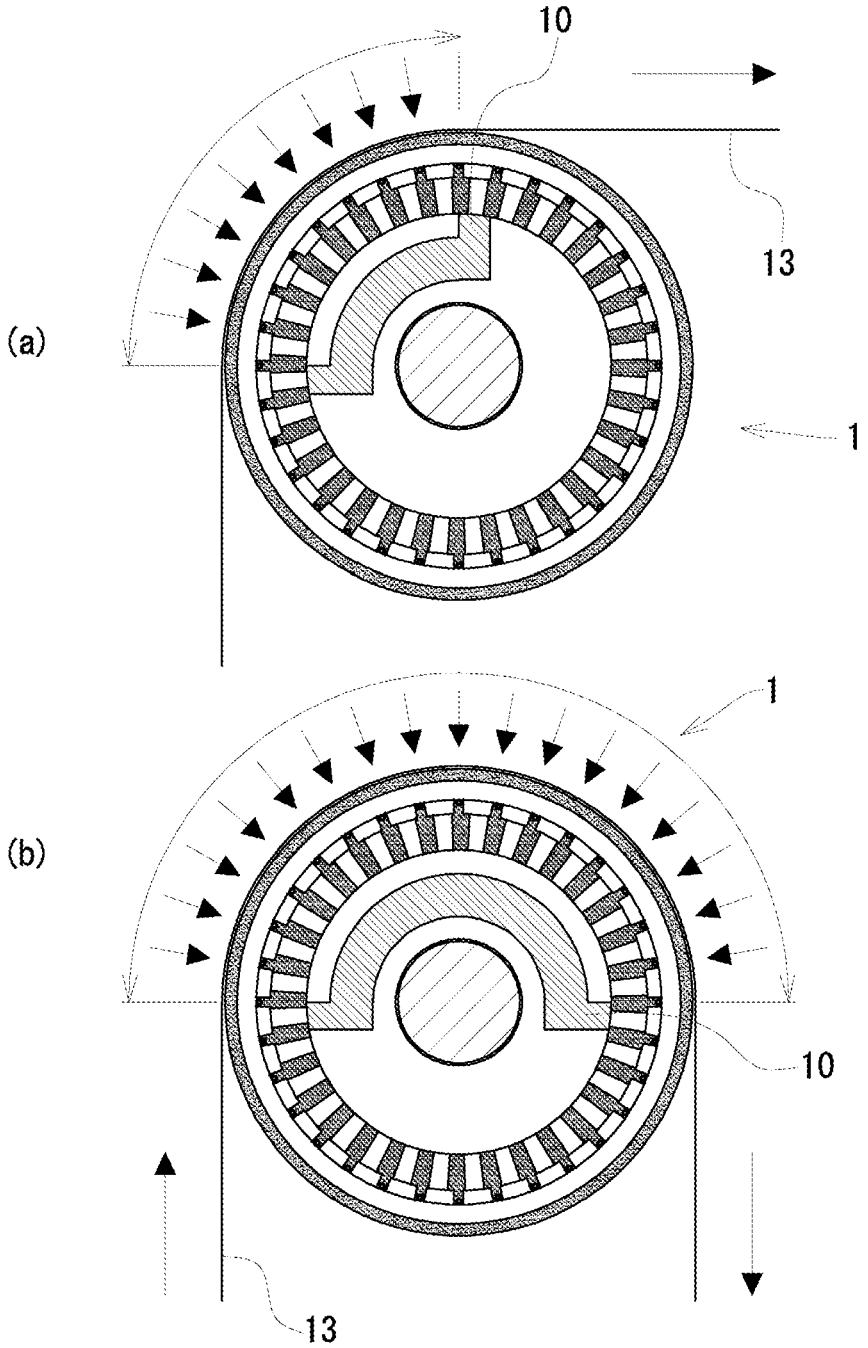
FIG. 13(*a*) is a schematic cross sectional view which shows the suction roll device having a 90-degree negative pressure region on a circumference of a roll, and FIG. 13(*b*) is a schematic cross sectional view which shows the suction roll device having a 180-degree negative pressure region.

FIG. 12(*a*) is a schematic diagram which shows one example of the suction roll device that is arrayed on a winding side of a slitter line, and FIG. 12(*b*) is a schematic diagram which shows another example. FIG. 13(*a*) is a schematic cross sectional view which shows the suction roll device having a 90-degree negative pressure region on the circumference of the roll, and FIG. 13(*b*) is a schematic cross sectional view which shows the suction roll device having a 180-degree negative pressure region.

As shown in FIG. 12(*a*), the negative pressure roll 1 which is an example of the suction roll device to which the present invention has been applied is arrayed within a step of the slitter line 22. As an example which shows the thus arrayed negative pressure roll 1, in FIG. 12(*a*), the negative pressure roll 1 is arrayed between separators 23 and 23 for providing an empty space between metal strips.

First, a wide metal strip coil is drawn from an uncoiler (not illustrated), cut to a desired width by a slitter (not illustrated) and, thereafter, supplied to the separator 23 which provides an empty space between multiple metal strips 13. The metal strip 13 is wound up by the recoiler 24.

The metal strip 13 which has passed through the separator 23 comes into contact with the multi-layered non-woven fabric laminated outer layer 5 of the negative pressure roll 1 from below. At this time, frictional engagement is made between the multi-layered non-woven fabric laminated outer layer 5 and a contact surface of the metal strip 13, thereby rotating the negative pressure roll 1 so as to be pulled by a frictional force.

Air inside the negative pressure roll 1 is sucked by the vacuum pump, by which a negative pressure is developed at the negative pressure conduction portion 10 of the negative pressure roll 1, the negative pressure conduction holes 8, the negative pressure conduction grooves 14, the ventilation holes 16 of the intermediate cylinder 4 and the multi-layered non-woven fabric laminated outer layer 5. The negative pressure can be adjusted for its magnitude by using the negative pressure adjusting valve 11.

The surface of the metal strip 13 in contact with the negative pressure roll 1 is subjected to pressing derived from an atmospheric pressure in proportion to a negative pressure developed inside the negative pressure roll 1. Further, the controller 6 installed on the negative pressure roll 1 is able to apply a braking force to the rotation. Thereby, a winding tensile force which acts in a direction reverse to a direction of being pulled by the recoiler 24 is imparted to the metal strip 13.

The winding tensile force gives a tension when the metal strip 13 is wound up by the recoiler 24, thus making it possible to neatly wind up the metal strip 13. Further, the non-woven fabric 20 of the multi-layered non-woven fabric laminated outer layer 5 in contact with the metal strip 13 is provided with appropriate elasticity. Therefore, upon occurrence of a frictional force, the non-woven fabric 20 is less likely to damage the face in contact with the metal strip 13.

The metal strip 13 which has passed through the negative pressure roll 1 is angulated by a deflector roll 26 and wound up by the recoiler 24. Thereby, the metal strip 13 is completely converted to a coil-shaped material.

Figure 14:
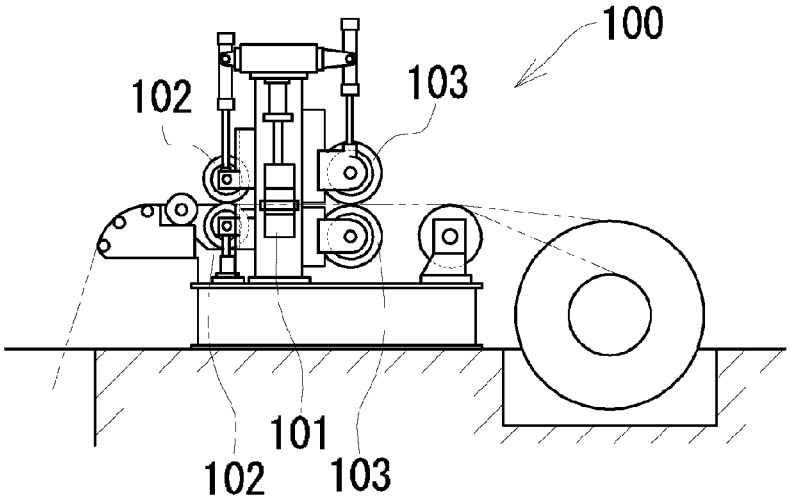
FIG. 14(*a*) is a schematic diagram which shows a conventional winding tensile force imparting device, and FIG. 14(*b*) is a schematic diagram which shows the conventional suction roll device 200.
Figure 14:
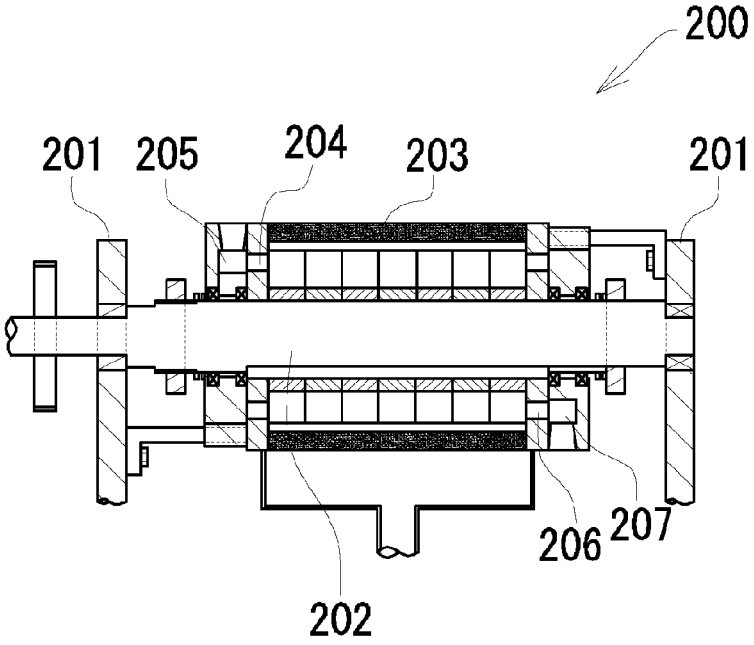
Figure 15:
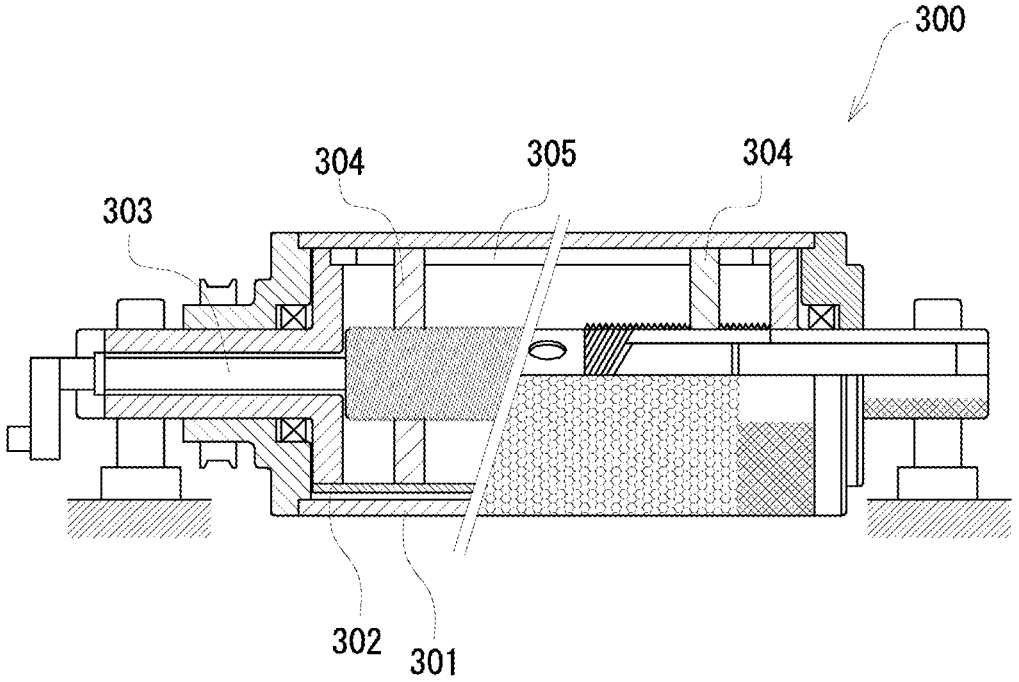
FIG. 15 is a schematic diagram which shows the conventional suction roll device 300.

Further, as shown in FIG. 12(*b*), in dealing with a thick metal strip which requires a great winding tensile force, the negative pressure roll 1 can be used together with a belt-type tension method device 25. Alternatively, in dealing with a material in which some damage does not pose a problem, the negative pressure roll 1 is arrayed at the parts of rolls (102 and 103) given in FIG. 14(*a*) and used together with a tension pad 101, thus making it possible to efficiently impart a winding tensile force.

As described so far, the negative pressure roll 1 which is made of a surface material low in breathability will not suck in extra air, thereby keeping an internal negative pressure high, and the negative pressure roll 1 is able to impart a sufficient winding tensile force even where there is a clearance between strips of multiple metal strips.

Further, the suction roll device does not have such a mechanism in which a member such as a pad is used to directly press the metal strip 13. Therefore, the device is able to impart an appropriate winding tensile force to a metal strip narrow in slit width and a thin metal strip without damaging the metal strips.

Further, wide sheet-like products formed with paper, resin and the like can also be adsorbed on the negative pressure roll 1 and reliably gripped and conveyed. A sheet-like product formed with paper is not required to be adsorbed at a great negative pressure, unlike a metal strip, and can be handled by decreasing the negative pressure by the use of the negative pressure adjusting valve 11.

Further, the negative pressure roll 1 which is composed of a surface material low in breathability will not suck in extra air. Therefore, where a sheet-like product is changed in width of a material, the negative pressure roll 1 does not need a partition strip or the like for adjusting a negative pressure region in the longitudinal direction of the roll and is able to exhibit a sufficient gripping force with a simple arrangement.

Further, a winding tensile force can be adjusted through adjustment of a braking force by means of the controller 6 to produce an extremely low tensile force. It is possible to impart an extremely low tensile force to an extremely thin strip with the thickness of about several μm such as a metal foil, for example. Still further, since the extremely thin strip will be adsorbed by a negative pressure of the negative pressure roll 1, no slipping takes place between the negative pressure roll and the extremely thin strip. Thereby, it is possible to impart a sufficient winding tensile force. In addition, in an attempt to impart a tensile force to an extremely thin strip by the use of a conventional multiple strip belt-type winding tensile force imparting device, marks resulting from a belt edge will adhere on the strip, and slipping takes place between the extremely thin strip and the strip. Thus, no winding tensile force can be imparted. Alternatively, in a conventional tension pad method, abrasions will adhere on the strip, which poses a problem.

Further, the negative pressure roll 1 is increased in diameter to impart a greater winding tensile force. That is, a sufficient winding tensile force can be imparted to a thick metal strip, finding a variety of applications of the negative pressure roll 1.

Further, as shown in FIG. 13(*a*), in the negative pressure roll 1, the negative pressure conduction portion 10 is formed at an approximately 90-degree region on the circumference of the negative pressure roll 1. In this case, the negative pressure roll 1 can be provided at a position at which the metal strip 13 rises from below and, therefore, easily arrayed on an existing slitter line. The negative pressure roll 1 can also be easily arrayed on a line of gripping and conveying sheet-like products.

Further, as shown in FIG. 13(*b*), the negative pressure conduction portion 10 can be formed at an approximately 180-degree region on the circumference of the negative pressure roll 1. In this case, since the negative pressure conduction portion 10 comes into contact with a metal strip 13 rising from below at the approximately 180-degree region on the negative pressure roll 1, it is possible to exert a great negative pressure. That is, it is possible to exert a greater winding tensile force or a greater gripping force. Further, if the negative pressure conduction portion 10 is made available as an exchange part having any given angle, it becomes possible to arbitrarily adjust a negative pressure region in the circumferential direction.

Further, the suction roll device to which the present invention has been applied is also able to deal with a problem specific to multiple metal strips. This problem is a difference in speed among metal strips.

First, it is known that a metal strip coil prior to cutting which is supplied to a slitter line has a variation in thickness of a metal strip which is different in thickness in a width direction thereof even when the metal strip is the same flat strip, due to a problem during processing. The variation in thickness will result in a difference in outer diameter of a wound coil when the metal strip is cut into multiple strips and then wound up by a recoiler.

Where there is a difference in outer diameter between coils of wound-up metal strips, a coil of a metal strip greater in outer diameter is wound up faster to cause a slight difference in speed between the metal strips on the negative pressure roll due to a difference in the outer diameter. At this time, the negative pressure roll rotates by being pulled by a metal strip greater in outer diameter, and a roll for winding up a metal strip smaller in outer diameter sags to result in a failure in tightly winding the metal strip.

At this time, the controller 6 is used to intensify a braking force to suppress the rotation speed of the negative pressure roll 1, by which a metal strip wound up at a greater speed is allowed to slip slightly on the negative pressure roll and a winding tensile force can be imparted to the sagging metal strip as well.

However, where only a braking force is controlled in an attempt to deal with a metal strip with a smaller outer diameter on a winding-up roll which still sags in a state that the braking force has been intensified, there may be a case in which the braking force is excessively intensified to impart an excessively great winding tensile force to all metal strips. In other words, the attempt may result in a coil which is wound up too tightly.

Therefore, the negative pressure adjusting valve 11 is used to lower the negative pressure, by which a coil of a wound-up metal strip greater in outer diameter is allowed to slip easily on the negative pressure roll without intensifying the braking force. While a metal strip which is wound up at a greater speed is allowed to slip, an appropriate winding tensile force is imparted to a strip wound up at a lower speed, thus making it possible to impart a uniform winding tensile force to all the metal strips.

Further, even if a metal strip slips on the negative pressure roll, no abrasions will be found on the surface of the metal strip due to a slight difference in time when the negative pressure roll 1 passes through a negative pressure region. As described above, the suction roll device to which the present invention has been applied is able to deal with a problem in a difference in speed caused between multiple metal strips and also able to impart a uniform winding tensile force without damaging the multiple metal strips.

As described so far, the suction roll device of the present invention increases a negative pressure degree inside the device without damaging a metal strip, thus making it possible to impart a sufficient winding tensile force. The suction roll device is also able to impart a winding tensile force to a thin strip and a narrow strip. The device is also able to grip and convey sheet-like products formed with paper, resin and the like. Further, the device is able to impart a uniform winding tensile force to multiple metal strips.

Therefore, the suction roll device of the present invention is able to sufficiently grip and convey or control a variety of long materials without damaging them and also able to reliably wind them up.

DESCRIPTION OF REFERENCE NUMERALS

1: Negative pressure roll
2: Rotating shaft
3: Internal cylinder
4: Intermediate cylinder
5: Multi-layered non-woven fabric laminated outer layer
6: Controller
7: Bearing
8: Negative pressure conduction hole
9: Reinforcement circular disk
10: Negative pressure conduction portion
11: Negative pressure adjusting valve
12: Negative pressure gauge
13: Metal strip
14: Negative pressure conduction groove
15: Partition projection
16: Ventilation hole
17: Ventilation hole groove portion (four directions)
18: Ventilation hole groove portion (eight directions)
19: Perforated metal
20: Non-woven fabric low in breathability
21: Non-woven fabric
22: Slitter line
23: Separator
24: Recoiler
25: Belt-type tension method device
26: Deflector roll
27: Electric motor
28: Detachable joint
29: High-density woven fabric
30: Generally used woven fabric
31: Small diameter hole of perforated metal
32: Rotating main body
Arrow Z: Direction in which negative pressure roll is sucked

What is claimed is:

1. A suction roll device, comprising:

a rotating body which has a rotating main body which is arranged so as to rotate freely, a conduction hole which is installed inside the rotating main body to develop a negative pressure by a predetermined suction device, and a conduction groove which is formed on the surface of the rotating main body and is connected to the conduction hole;

a control portion which suppresses rotation of the rotating main body;

an air-permeable outer layer portion which is formed outside the conduction groove, is provided with elasticity and frictional property, and is at 0.2 $cm^3/cm^2 \cdot s$ or less in air permeability measured by a Frazier type air permeability tester; and an intermediate cylinder portion which is installed between the conduction groove and the air-permeable outer layer portion, is formed substantially in a cylindrical shape to have a plurality of ventilation holes, and is provided with at least one ventilation hole groove portion which is formed on an outer surface of the intermediate cylinder portion and in a radial direction with one of the plurality of ventilation holes at a center.

2. The suction roll device according to claim 1, wherein the air-permeable outer layer portion is formed with a non-woven fabric.

3. The suction roll device according to claim 1, wherein the rotating main body is able to rotate by a frictional force developed between itself and a target substance in contact with the air-permeable outer layer portion.

4. The suction roll device according to claim 1, wherein the rotating main body is formed substantially in a cylindrical shape, a plurality of conduction holes are formed in the circumferential direction of the rotating main body and the conduction holes are adjacent to each other, with a fixed interval kept, and a plurality of conduction grooves are formed in the longitudinal direction of the rotating main body and the conduction grooves are adjacent to each other, with a fixed interval kept.

5. The suction roll device according to claim 1, further comprising:

a driver which rotates the rotating main body; and a clutch which attaches the driver to the rotating main body in a detachable manner.

6. The suction roll device according to claim 1, wherein the rotating body is arranged so as to adjust a quantity of air flowing through the conduction hole.

7. The suction roll device according to claim 1, wherein the rotating body is such that the conduction hole is substantially equal to the conduction groove in total cross sectional area.

8. A suction roll device, comprising:

a rotating body which has a rotating main body which is arranged so as to rotate freely, a conduction hole which is installed inside the rotating main body to develop a negative pressure by a predetermined suction device, and a conduction groove which is formed on the surface of the rotating main body and is connected to the conduction hole;

a control portion which suppresses rotation of the rotating main body;

an outer layer portion which is formed outside and covering the conduction groove, is provided with elasticity and frictional property, and is at 0.2 $cm^3/cm^2 \cdot s$ or less in air permeability measured by a Frazier type air permeability tester; and an intermediate cylinder portion which is installed between the conduction groove and the outer layer portion, is formed substantially in a cylindrical shape to have a plurality of ventilation holes, and is provided with at least one ventilation hole groove portion which is formed on an outer surface of the intermediate cylinder portion and in a radial direction with one of the plurality of ventilation holes at a center.

9. The suction roll device according to claim 8, wherein the outer layer portion is formed with a non-woven fabric.

10. The suction roll device according to claim 8, wherein the rotating main body is able to rotate by a frictional force developed between itself and a target substance in contact with the outer layer portion.

11. The suction roll device according to claim 8, wherein the rotating main body is formed substantially in a cylindrical shape, a plurality of conduction holes are formed in the circumferential direction of the rotating main body and the conduction holes are adjacent to each other, with a fixed interval kept, and a plurality of conduction grooves are formed in the longitudinal direction of the rotating main body and the conduction grooves are adjacent to each other, with a fixed interval kept.

12. The suction roll device according to claim 8, further comprising:

a driver which rotates the rotating main body; and a clutch which attaches the driver to the rotating main body in a detachable manner.

13. The suction roll device according to claim 8, wherein the rotating body is arranged so as to adjust a quantity of air flowing through the conduction hole.

14. The suction roll device according to claim 8, wherein the rotating body is such that the conduction hole is substantially equal to the conduction groove in total cross sectional area.

* * * * *